US009098058B2

(12) United States Patent
Yoshimura et al.

(10) Patent No.: US 9,098,058 B2
(45) Date of Patent: Aug. 4, 2015

(54) IMAGE FORMING SYSTEM AND MAINTENANCE METHOD OF IMAGE FORMING SYSTEM

(75) Inventors: Kazutoshi Yoshimura, Hino (JP); Kenji Yamamoto, Hachioji (JP); Hideki Nakamura, Hachioji (JP); Akira Okamoto, Hino (JP)

(73) Assignee: KONICA MINOLTA, INC. (JP)

( * ) Notice: Subject to any disclaimer, the term of this patent is extended or adjusted under 35 U.S.C. 154(b) by 667 days.

(21) Appl. No.: 13/315,695

(22) Filed: Dec. 9, 2011

(65) Prior Publication Data

US 2012/0163834 A1 Jun. 28, 2012

(30) Foreign Application Priority Data

Dec. 22, 2010 (JP) ..... 2010-285386

(51) Int. Cl.
*G03G 15/00* (2006.01)
*G03G 21/16* (2006.01)
*G03G 15/23* (2006.01)

(52) U.S. Cl.
CPC ..... *G03G 21/1661* (2013.01); *G03G 15/6561* (2013.01); *G03G 15/235* (2013.01); *G03G 2215/00721* (2013.01)

(58) Field of Classification Search
CPC ..... G03G 21/1661
USPC ..... 399/9, 11, 24, 31
See application file for complete search history.

(56) References Cited

U.S. PATENT DOCUMENTS

2008/0266592 A1* 10/2008 Brougham et al. ..... 358/1.15

FOREIGN PATENT DOCUMENTS

JP 2001-056627 A 2/2001
JP 4457244 B2 2/2001
JP 2008-083302 A 4/2008

OTHER PUBLICATIONS

Office Action for the Chinese patent application No. 201110421781.8, mailed on Mar. 19, 2014. English translation attached.

* cited by examiner

*Primary Examiner* — Billy Lactaoen
(74) *Attorney, Agent, or Firm* — Cantor Colburn LLP

(57) ABSTRACT

An image forming system having a preceding stage apparatus for forming a toner image on a paper sheet, and a subsequent stage apparatus, connected downstream of the preceding stage apparatus, for forming a toner image on the paper sheet ejected from the preceding stage apparatus, includes: a first maintenance counter correlating with a part, subject to maintenance, in the preceding stage apparatus; a second maintenance counter correlating with a part, subject to maintenance, in the subsequent stage apparatus, in response to the first maintenance counter; a counter control section for increasing a count value of the first and the second maintenance counters by a first and a second designated value, respectively, in response to formation of a toner image on the paper sheet; and a setting section for setting the first and second designated values individually based on an operation mode of the image forming system.

20 Claims, 7 Drawing Sheets

FIG. 3a
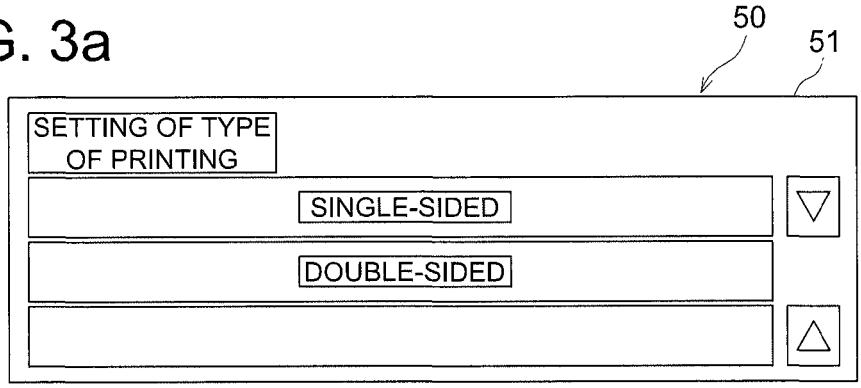
FIG. 3b
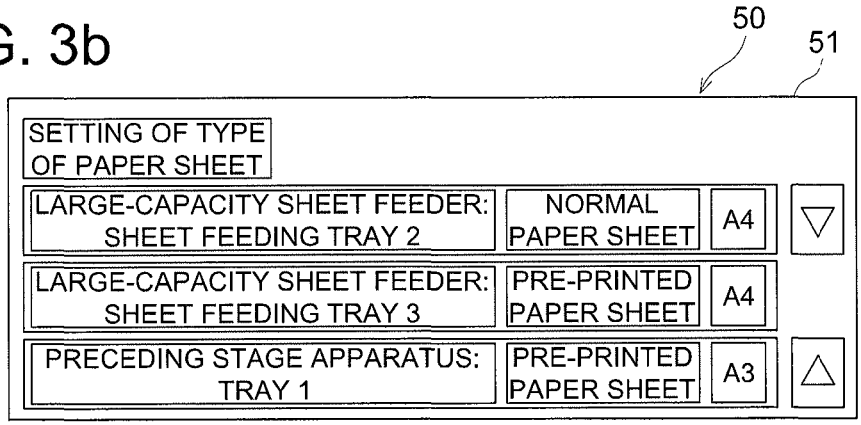
FIG. 4
| MAINTENANCE COUNTER | | PARTS |
|---|---|---|
| PRECEDING STAGE APPARATUS | SUBSEQUENT STAGE APPARATUS | |
| COUNTER CF1 | COUNTER CB1 | EXHAUST FAN FILTER |
| COUNTER CF2 | COUNTER CB2 | CONVEYANCE SYSTEM ROLLERS |
| COUNTER CF3 | COUNTER CB3 | BRUSHES FOR ROLLERS |
| COUNTER CF4 | COUNTER CB4 | PAPER SHEET SENSOR |
| COUNTER CF5 | COUNTER CB5 | WIRE ELECTRODE |
| ⋮ | ⋮ | ⋮ |
| COUNTER CFN | COUNTER CBN | DRUM CLEANING BLADE |

FIG. 5

| PRECEDING STAGE APPARATUS | | | SUBSEQUENT STAGE APPARATUS | | |
|---|---|---|---|---|---|
| COUNTER | COUNT VALUE | DESIGNATED VALUE FOR COUNTER | COUNTER | COUNT VALUE | DESIGNATED VALUE FOR COUNTER |
| CF1 | *** | ** | CB1 | *** | ** |
| CF2 | *** | ** | CB2 | *** | ** |
| CF3 | *** | ** | CB3 | *** | ** |
| CF4 | *** | ** | CB4 | *** | ** |
| CF5 | *** | ** | CB5 | *** | ** |
| ⋮ | ⋮ | ⋮ | ⋮ | ⋮ | ⋮ |
| CFN | *** | ** | CBN | *** | ** |

IMAGE FORMING SYSTEM AND MAINTENANCE METHOD OF IMAGE FORMING SYSTEM

This application is based on Japanese Patent Application No. 2010-285386 filed on Dec. 22, 2010 with the Japan Patent Office, the entire content of which is hereby incorporated by reference.

TECHNICAL FIELD

The present invention relates to an image forming system and a maintenance method of the image forming system.

BACKGROUND OF THE INVENTION

In recent years, a system has been practiced which includes a serial tandem type image forming system which carries out duplex printing, or the like, by connecting a plurality of image forming apparatuses in series. More specifically, in a case of a serial tandem type image forming system, in which two image forming apparatuses are connected in series, a toner image is formed on the front surface of a paper sheet via an image forming apparatus (preceding stage apparatus), arranged in a preceding stage, and a toner image is formed on the back surface of the paper sheet via an image forming apparatus (subsequent stage apparatus), arranged in a subsequent stage. In such a way, the printing speed can be improved, when compared with a case in which only one image forming apparatus carries out the duplex printing.

An image forming apparatus, which is equipped with a maintenance counter for determining the target parts for maintenance (the parts subject to maintenance), has been disclosed in Unexamined Japanese Patent Application Publication No. 2001-56627, as an example. In that image forming apparatus, a predetermined additional value is added to the count value of a maintenance counter in response to formation of a toner image on a paper sheet. In this case, the additional value is set to a value corresponding to the amount of paper dust generated from paper sheets onto which toner images are formed, and thus, the additional value is set to a larger value in cases in which the amount of generated paper dust is larger.

Meanwhile, an image forming apparatus which carries out additional printing to form a toner image on a paper sheet (pre-printed paper sheet), on which an image has been formed in advance, has been disclosed in Unexamined Japanese Patent Application Publication No. 2008-83302, as an example. According to the disclosure, vapor evolved from the preliminary formed images and compositions which form the images adheres onto the respective sections of the image forming apparatus, resulting in contamination of the apparatus, which prevents formation of an excellent image.

By the way, in the case of a serial tandem type image forming system, even in a case in which an individual image forming apparatus operates independently in response to formation of toner images on a single paper sheet, there is a probability that a maintenance cycle, with respect to the same target parts for maintenance, may vary from one image forming apparatus to another image forming apparatus. As an example, in the case of an operation mode of an image forming system in which pre-printed paper sheets are used, the level of contamination, caused by the pre-printed paper sheets, may vary from one image forming apparatus to another, and therefore, such a probability may be particularly possible. Therefore, in a case of a serial tandem type image forming system, the time of maintenance (the time when maintenance needs to be carried out) may not be determined appropriately. In such case, there exist problems that image forming performance may deteriorate, and/or apparatus downtime associated with unnecessary maintenance may occur.

SUMMARY OF THE INVENTION

The present invention has been achieved in consideration of the above problems, and it is one of the main objects to make it possible to determine respective times of maintenance appropriately, with respect to individual image forming apparatus which constitutes a serial tandem type image forming system.

An image forming system reflecting one aspect of the present invention includes, but is not limited to: a preceding stage apparatus which is an image forming apparatus for forming a toner image on a paper sheet, and a subsequent stage apparatus, which is an image forming apparatus and is connected downstream of the preceding stage apparatus, for forming a toner image on the paper sheet having been ejected from the preceding stage apparatus, wherein the image forming system includes, but is not limited to, a first maintenance counter which is correlated with a part, subject to maintenance, in the preceding stage apparatus; a second maintenance counter which is correlated with a part, subject to maintenance, in the subsequent stage apparatus, in correspondence with the first maintenance counter; a counter control section configured to increase a count value of the first maintenance counter by a first designated value, in response to formation of a toner image on a paper sheet, and (the same time,) increase a count value of the second maintenance counter by a second designated value; and a setting section configured to set the first designated value and the second designated value individually based on an operation mode of the image forming system.

A maintenance method of an image forming system; having a preceding stage apparatus, which is an image forming apparatus for forming a toner image on a paper sheet, and a subsequent stage apparatus, which is an image forming apparatus and is connected downstream of said preceding stage apparatus, for forming a toner image on the paper sheet having been ejected from said preceding stage apparatus; reflecting one aspect of the present invention includes, but is not limited, steps of: setting a first designated value that is used for a first maintenance counter in accordance with an operation mode of the image forming system, the first maintenance counter which is correlated with a part, subject to maintenance, in the preceding stage apparatus; setting a second designated value that is used for a second maintenance counter in accordance with an operation mode of the image forming system, the second maintenance counter which is correlated with a part, subject to maintenance, in the subsequent stage apparatus, in correspondence with the first maintenance counter; increasing a count value of the first maintenance counter by the first designated value, and also increasing a count value of the second maintenance counter by the second designated value.

BRIEF DESCRIPTION OF THE DRAWINGS

The preferred embodiments of the present invention are shown by way of example, and not limitation, in the accompanying figures, in which:

FIGS. 3*a* and 3*b* are each an explanatory diagram illustrating an example of an input method of an operation mode via operation section 50.

FIG. 4 is an explanatory diagram illustrating a correspondence relationship between maintenance counter 22 and parts subject to maintenance.

FIG. 5 is an explanatory diagram illustrating maintenance counter 22.

DETAILED DESCRIPTION OF THE PREFERRED EMBODIMENTS

First Preferred Embodiment

Figure 1:
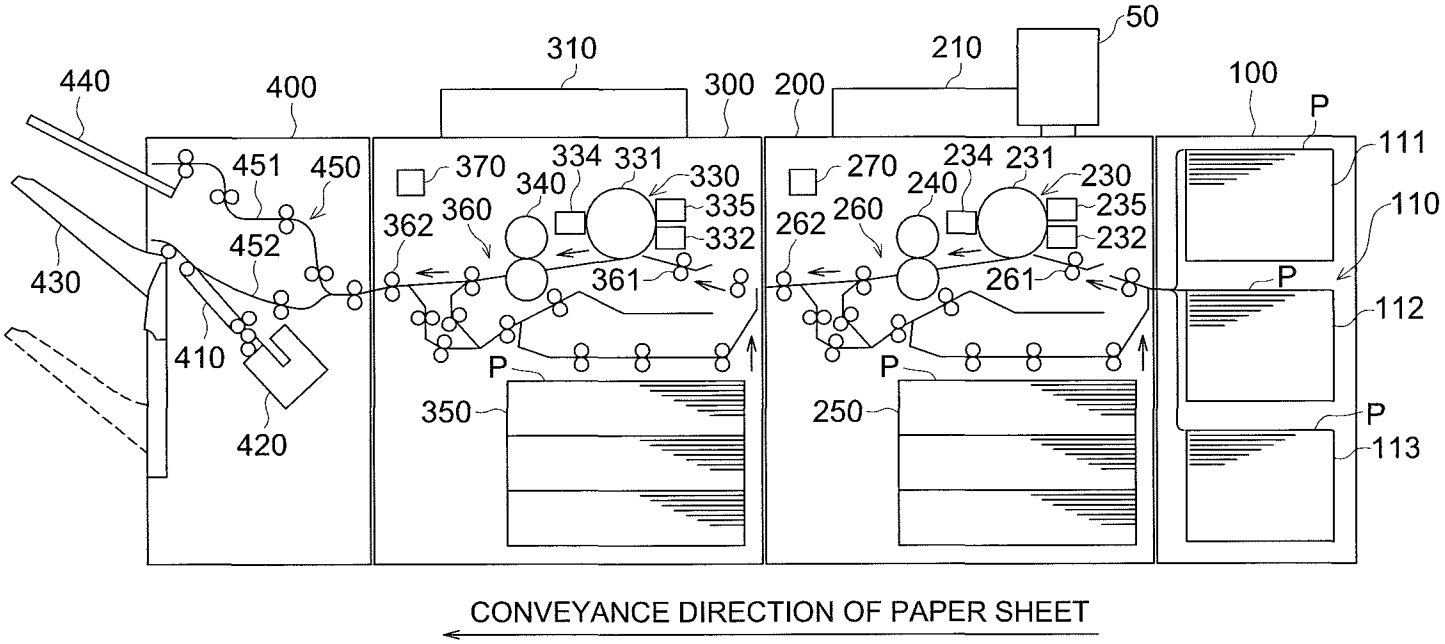
FIG. 1 is a diagram schematically illustrating a constitution of an image forming system.

FIG. 1 is a diagram schematically illustrating a constitution of an image forming system according to a first preferred embodiment. The image forming system is composed of, but is not limited to, large-capacity sheet feeder 100, preceding stage apparatus 200, subsequent stage apparatus 300, and post-processing apparatus 400. Each of preceding stage apparatus 200 and subsequent stage apparatus 300 is an electrophotographic image forming apparatus such as a copying machine, for example, and this image forming system has a constitution of a serial tandem type image forming system in which two image forming apparatuses are connected in series. In the image forming system, a toner image is formed on the front surface of paper sheet P via one image forming apparatus (preceding stage apparatus 200 as an example), and a toner image is formed on the back surface of paper sheet P via the other image forming apparatus (subsequent stage apparatus 300 as an example) so that the speedup of printing can be attained.

Large-capacity sheet feeder 100 is a feeder to store a large quantity of paper sheets P and to feed paper sheets P to the image forming apparatus. This large-capacity sheet feeder 100 is connected to the front stage side of preceding stage apparatus 200 in series in the conveyance direction of paper sheet. Large-capacity sheet feeder 100 is mainly composed of sheet feeding section 110. This sheet feeding section 110 is composed of a plurality of sheet feeding trays (three sheet feeding strays 111 to 113, for example), and, as an example, each sheet feeding tray stores paper sheets P of different size.

Preceding stage apparatus 200 forms a toner image on paper sheet P, by transferring toner images onto paper sheet P and by carrying out a fixing process, and ejects this paper sheet P to subsequent stage apparatus 300. Preceding stage apparatus 200 is composed mainly of automatic document feeder 210, image reading section 220 (refer to FIG. 2), image forming section 230, fixing section 240, sheet feeding section 250, and conveyance section 260.

Automatic document feeder 210 conveys a document, placed on a document platen, via a conveyance mechanism to image reading section 220. Image reading section 220 reads an image of the document by scanning and exposing the image on one side or both sides of the document, and generates image data of the image. In image reading section 220, the generated image data is subjected to a shading correction, an image compressive processing, and the like, and after that, reading section 220 outputs image data to preceding stage apparatus control section 20 (refer to FIG. 2).

Image forming section 230 is composed of but is not limited to, photosensitive drum 231, developing unit 232, drum cleaning section 234, and exposing section 235. Developing unit 232 is composed mainly of, as examples, wire electrode 233 (refer to FIG. 2) which constitutes a charging section (not illustrated in the figure), and a developing section (not illustrated in the figure). The charging section uniformly charges the circumferential surface of the photosensitive drum 231. Exposing section 235 irradiates laser light to photosensitive drum 231 so as to form an electrostatic latent image on the surface thereof. The developing section develops the electrostatic latent image formed on photosensitive drum 231 to form a toner image. Drum cleaning section 234 removes residual toners on the surface of photosensitive drum 231 after completion of transfer of the toner image. It should noted that, although a toner image is formed on photosensitive drum 231 via an electro-photographic process in this preferred embodiments, it is not limited to the process as an image forming apparatus.

Sheet feeding section 250 is composed of a plurality of sheet feeding trays. In each sheet feeding tray, paper sheets P of different kind and size are stored. This sheet feeding section 250 conveys paper sheet P, having been stored in a sheet feeding tray, one by one to conveyance section 260.

After paper sheet P, having been selected by the user, has been guided to the inside of preceding stage apparatus 200 from large-capacity sheet feeder 100, or from sheet feeding section 250, paper sheet P is conveyed to conveyance section 260 which includes registration roller 261. Paper sheet P, having been conveyed, is further conveyed to image forming section 230, in synchronization with the toner image, via registration roller 261, and in this way, the toner image is transferred onto the surface of paper sheet P. Paper sheet P, onto which the toner image has been transferred, is further conveyed to fixing section 240.

Fixing section 240 is composed of a heating roller and a pressing roller. A heating source (not illustrated in the figure) is built into the heating roller, and the temperature of the heating roller is controlled at a constant temperature via the heating source. As paper sheet P passes through a nip section, which is a pressure-contact section between the heating roller and the pressing roller, in the conveyance process of paper sheet P, the toner image, having been transferred onto paper sheet P, is heated and pressed, and thereby, the toner image is fixed onto paper sheet P.

Paper sheet P, on which the fixing process has been performed via fixing section 240, is ejected into adjacent subsequent stage apparatus 300 via sheet ejection roller 262 which constitutes conveyance section 260. Meanwhile, in cases in which paper sheet P is ejected after being turned upside down, conveyance section 260 guides paper sheet P downward once via a guiding member (not illustrated in the figure). After that, conveyance section 260 reverses and conveys this paper sheet P, and ejects paper sheet P into subsequent stage apparatus 300, by guiding paper sheet P to sheet ejection roller 262.

Meanwhile, in this preceding stage apparatus 200, exhaust fan 270 is provided so as to exhaust the atmosphere inside a casing of the apparatus.

Subsequent stage apparatus 300 forms a toner image on paper sheet P by transferring toner images onto paper sheet P and by performing the fixing process, and ejects this paper sheet P into post-processing apparatus 400. Subsequent stage apparatus 300 has basically the same constitution of preceding stage apparatus 200, and is composed of automatic document feeder 310, image reading section 320 (refer to FIG. 2), image forming section 330, fixing section 340, sheet feeding section 350, and conveyance section 360. Since each constitution of automatic document feeder 310, image reading section 320, image forming section 330, fixing section 340, sheet feeding section 350, and conveyance section 360 corresponds to that of each automatic document feeder 210, image reading section 220, image forming section 230, fixing section 240, sheet feeding section 250, and conveyance section 260 of preceding stage apparatus 200, the explanations of those are omitted.

Post-processing apparatus 400 is an apparatus to perform post-processing with respect to paper sheet P, having been conveyed from preceding stage apparatus 200 or from subsequent stage apparatus 300, and is connected to the subsequent stage side of subsequent stage apparatus 300 in series in the conveyance direction of paper sheet. This post-processing apparatus 400 is composed mainly of intermediate stacker 410, stapler 420, elevating sheet ejection tray 430, fixed sheet ejection tray 440, and conveyance section 450.

Paper sheet P, having been guided into the post-processing apparatus, is conveyed either toward lower conveyance path 452 or toward upper conveyance path 451 in accordance with the switchover via switching gate (not illustrated in the figure) which constitutes conveyance section 450.

Paper sheet P, having been conveyed through lower conveyance path 452, is either ejected onto intermediate stacker 410 temporarily, or onto elevating sheet ejection tray 430 via intermediate stacker 410. Paper sheet P, having been conveyed to intermediate stacker 410, is subjected to stapling processing via stapler 420 after a plurality of paper sheets P has been stacked, and ejected onto elevating sheet ejection tray 430. Elevating sheet ejection tray 430 is disposed at the middle level outside the apparatus, and is configured to be movable (move up and down) in the stacking direction so as to permit a large number of paper sheets to be ejected.

Paper sheet P, having been conveyed through upper conveyance path 451, is ejected onto fixed sheet ejection tray 440. Because fixed sheet ejection tray 440 has a low stacking capacity, the tray is mainly used to eject a particular paper sheet P, such as post card or thick paper, which is frequently used in small amounts of ejection.

Figure 2:
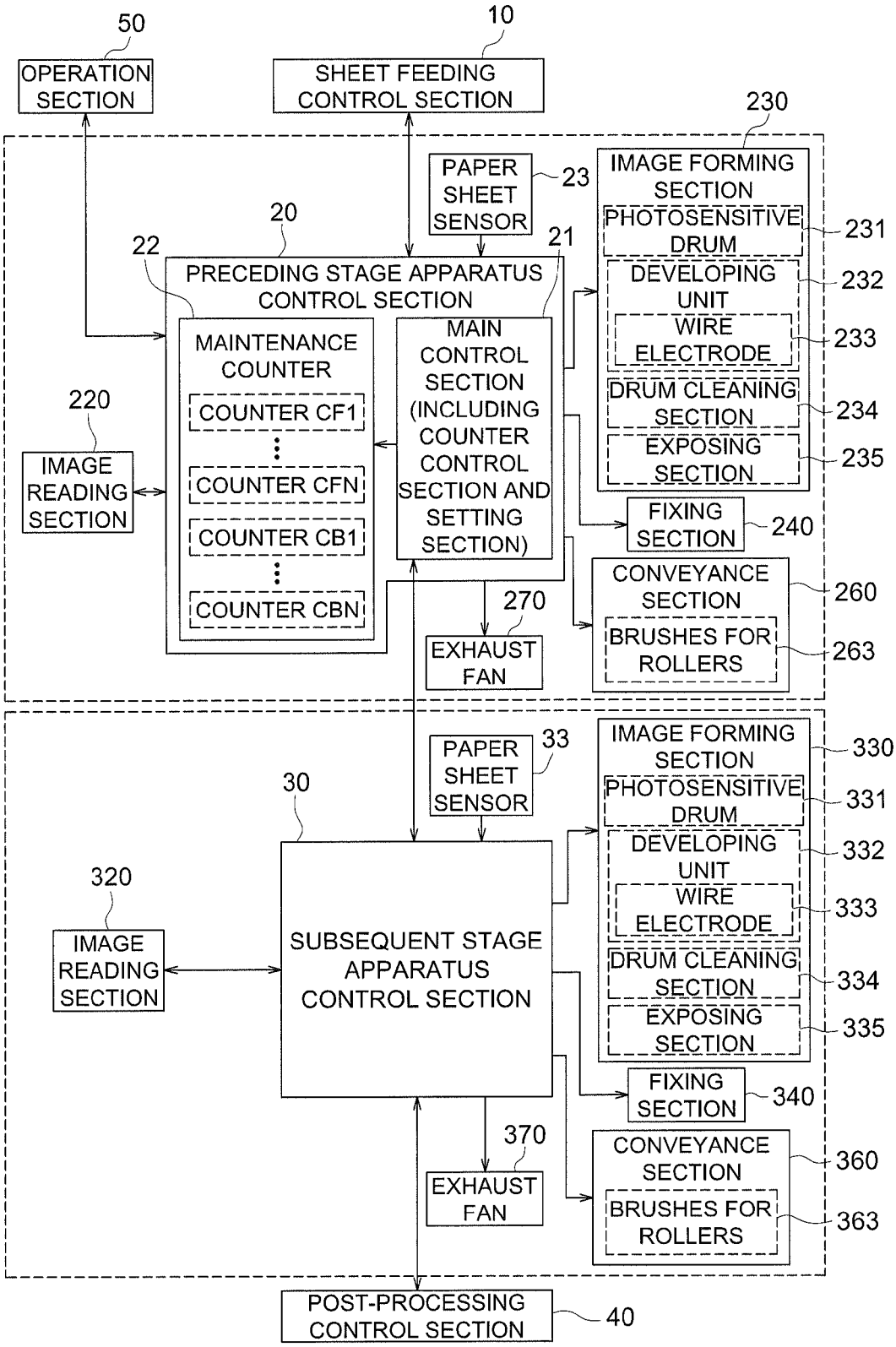
FIG. 2 is a block diagram illustrating a control system of the image forming system.

FIG. 2 is a block diagram illustrating a control system of the image forming system according to this preferred embodiment. The control system of the image forming system is composed mainly of sheet feeding control section 10, preceding stage apparatus control section 20, subsequent stage apparatus control section 30, and post-processing control section 40. Each of those control sections 10 to 40 is configured to be able to communicate with each other.

Sheet feeding control section 10 takes charge of all functions to control large-capacity sheet feeder 100 wholly. Sheet feeding control section 10 is configured to convey paper sheet P, which has been selected by the user, one by one to preceding stage apparatus 200. A micro-computer, which is composed mainly of a CPU (central processing unit), ROM (read only memory), RAM (random access memory), and I/O (input/output) interfaces, may be used as sheet feed control section 10.

Preceding stage apparatus control section 20 takes charge of all functions to control the image forming apparatus, namely preceding stage apparatus 200 wholly, and at the same time, takes charge of all functions to control each of control sections 10, 30 and 40 wholly. A micro-computer, which is composed mainly of a CPU, ROM, RAM, and I/O interfaces, may be used as preceding stage apparatus control section 20. A variety of information, output from operation section 50 and paper sheet sensor 23, in addition to the above-described image reading section 220, is input into this preceding stage apparatus control section 20.

Operation section 50 is provided at a top of a body of preceding stage apparatus 200, for example, and obtains a variety of information which is input via the user. As operation section 50, a touch panel may be used, which allows input operations to be performed in conformity to the information displayed on the display, as an example. Via this operation section 50, the user can provide instructions, to preceding stage apparatus control section 20, on the operation modes of the image forming system, more specifically, the modes which specify a variety of operation conditions of the image forming system, such as image forming conditions, paper sheet conditions, post-processing conditions, or the like. Here, the image forming conditions are, for example, the printing classification such as single-sided printing or double-sided printing, the density and magnification rate of the image, the number of prints, and the like, and the paper sheet conditions are the type and basis weight of paper sheet, or the like, such as manufacturer type, size, normal paper sheet/thick paper sheet/pre-printed paper sheet. Post-processing conditions are the presence or absence of post-processing, and the type of post-processing, or the like.

As illustrated in FIG. 3*a*, the user can instruct the type of printing, such as single-sided printing or double-sided printing by referencing to the information displayed on display screen 51, via operation section 50. Also, as an example, as illustrated in FIG. 3*b*, the user can instruct the paper sheet conditions by selecting a sheet feeding tray, onto which paper sheets P have been stored, via operation section 50. Also, by bringing paper sheet P, which is stored on a sheet feeding tray, into correspondence with the manufacturer type and basis weight of paper sheet P in advance, the user can instruct the type of paper sheet P in detail via selection of that sheet feeding tray. It should be noted that the instructions on the operation modes of the image forming system to preceding stage apparatus control section 20 may be performed via a personal computer or other image forming apparatus, other than operation section 50.

Paper sheet sensor 23 includes sensors to detect misalignment of conveyance position of paper sheet P and a variety of sensors to detect the arrival timings of paper sheet P in paper sheet conveyance paths. As paper sheet sensor 23, a linear image sensor (as an example, CCD (charge-coupled device) line sensor, or the like) in which a plurality of light-receiving elements is arranged in series, or an optical sensor composed of a light-emitting element and a light-receiving element, or the like, may be used.

Preceding stage apparatus control section 20 includes main control section 21 and maintenance counter 22 for performing the functions of preceding stage apparatus control section 20.

Main control section 21 is configured to obtain image data via image reading section 220, and also to calculate the ratio of printing with respect to the front and back surface of paper sheet P based on the image data. As a computation method of the ratio of printing, a computation method using a rough unit such as standard ratio of printing or low ratio of printing may be used, other than a method in which an exact value is calculated. Via such computation, main control section 21 can recognize the ratio of printing which is one of the operation modes (image formation conditions) of the image forming system. Also, main control section 21 is configured to obtain an operation mode which is designated by the user via operation section 50. Further, main control section 21 is configured to recognize the arrival timing and the conveyance position of paper sheet P by reading the detection result of paper sheet sensor 23.

Also, main control section 21 executes a series of processes described below by controlling each section of preceding stage apparatus 200 (image forming section 230, fixing section 240, sheet feeding section 250, and conveyance section 260):

Process (1): Charging photosensitive drum 231 via the charging section,

Process (2): Forming electrostatic latent images on photosensitive drum 231 via exposing section 235, Process (3): Adhering toners onto the electrostatic latent images, having been formed, via the developing section, Process (4): Transferring the toner images on photosensitive drum 231 onto paper sheet P, Process (5): Performing the fixing process on paper sheet P, onto which the toner images have been transferred, Process (6): Conveying paper sheet P.

Main control section 21 is provided with functions of a counter control section to control maintenance counter 22 for determining the time of maintenance, which is related to this embodiment. Here, maintenance represents maintenance work which is necessary to maintain the performance of the image forming apparatus, and includes both maintenance work which is performed independently by the system itself; and maintenance work which is carried out by manpower.

Maintenance counter 22 in provided with a plurality of counters CF1-CFN, and CB1-CBN (N: natural number of 1 or more). Counters CF1-CFN represent a group of counters provided in preceding stage apparatus 200, and each of counters CF1-CFN mutually corresponds to each of the parts subject to maintenance. Hereinafter, those counters are referred to as "preceding stage counters CF1-CFN". Meanwhile, counters CB1-CBN represent a group of counters provided to subsequent stage apparatus 300, and each of counters CB1-CBN mutually corresponds to each of the parts subject to maintenance. Hereinafter, those counters are referred to as "subsequent stage counters CB1-CBN".

As illustrated in FIG. 4, examples of the parts subject to maintenance include, but are not limited to, exhaust fan filter (not illustrated in the figure), conveyance system rollers (not illustrated in the figure), brushes 263 and 363 for rollers, paper sheet sensors 23 and 33, wire electrodes 233 and 333, and drum cleaning sections 234 and 334. For the parts subject to maintenance which are the same in both preceding stage apparatus 200 and subsequent stage apparatus 300, preceding stage counters CF1-CFN and subsequent stage counters CB1-CBN corresponding to each other are associated with the parts. For example, preceding stage counter CF1 is associated with the exhaust fan filter in preceding stage apparatus 200, and subsequent stage counter CB1 is, in corresponding to said preceding stage counter CF1, associated with such part subject to maintenance in subsequent stage apparatus 300, namely, exhaust fan filter in subsequent stage apparatus 300.

The exhaust fan filters are each provided for exhaust fans 270 and 370, and are filters to remove paper dust, and the like. The conveyance system rollers include each of rollers which constitute sheet feeding sections 250 and 350, and conveyance sections 260 and 360. It should be noted that, because the frequency of the usage of each roller differs depending on the conveyance path of paper sheet P, those rollers may be divided into a plurality of groups, and a counter may be associated with each of those groups. Brushes 263 and 363 for rollers are to remove dusts (such as paper dust and dusting powder, which will be described later), having adhered to the conveyance system rollers. Wire electrodes 233 and 333 are each a member which constitutes a wire-electrode type charging section which constitutes image forming sections 230 and 330, respectively. Drum cleaning sections 234 and 334 each is a member to remove residual toner on the surface of photosensitive drums 231 and 331 from which toner images have been transferred onto paper sheet P, and is composed of a blade, as an example.

As illustrated in FIG. 5, main control section 21 is configured to increase the count values of preceding stage counters CF1-CFN by designated values for preceding stage counters, and at the same time, increase the count values of subsequent stage counters CB1-CBN by designated values for subsequent stage counters, which functions as a counter control section.

Also, main control section 21 is configured to include functions of a setting section for setting the designated values for preceding stage counters and the designated values for subsequent stage counters individually for each of the parts subject to maintenance in accordance with an operation mode of the image forming system. For the individual designated count value, a reference value (standard value (such as "1.0", as an example)) is predetermined based on a standard paper sheet such as normal paper sheet of A4 size (hereinafter referred to as "standard paper sheet"). The reference value is a value on which the designated count value is based. Main control section 21 is configured to set each of the designated values for preceding stage counters and the designated values for subsequent stage counters individually, based on the standard value, in accordance with an operation mode of the image forming system. For example, main control section 21 is configured to possess a table in advance which specifies a relationship between an operation mode of the image forming system and designated values of preceding and subsequent stage counters, and to set the designated value for preceding stage counter and the designated value for subsequent stage counter individually based on the operation mode after referring to the table.

Also, main control section 21 is configured to determine whether or not a time of maintenance has been reached based on the count values of preceding stage counters CF1-CFN, and count values of subsequent stage counters CB1-CBN. If it is determined that a time of maintenance has been reached, main control section 21 makes a maintenance request.

By referring to FIG. 2 again, subsequent stage apparatus control section 30 takes charge of all functions to control the image forming apparatus which is subsequent stage apparatus 300. A micro-computer, which is composed mainly of a CPU, ROM, RAM, and I/O interfaces, may be used as subsequent stage apparatus control section 30. A variety of information, output from paper sheet sensor 33, in addition to the above-described image reading section 320, is input into this subsequent stage apparatus control section 30.

Paper sheet sensor 33 includes sensors to detect conveyance misalignment of paper sheet P and a variety of sensors to detect the arrival timings of paper sheet P in paper sheet conveyance paths. As paper sheet sensor 33, a linear image sensor (as an example, CCD (charge-coupled device) line sensor, or the like) in which a plurality of light-receiving elements is arranged in series, or an optical sensor composed of a light-emitting element and a light-receiving element, or the like, may be used.

Subsequent stage apparatus control section 30 executes a series of processes described below by controlling each section (image forming section 330, fixing section 340, sheet feeding section 350, and conveyance section 360) of preceding stage apparatus 300:

Process (1): Charging photosensitive drum 331 via the charging section,

Process (2): Forming electrostatic latent images on photosensitive drum 331 via exposing section 335, Process (3): Adhering toner onto the electrostatic latent images, having been formed, via the developing section, Process (4): Transferring the toner images, on photosensitive drum 331, onto paper sheet P, Process (5): Performing the fixing process on paper sheet P, onto which the toner images have been transferred, Process (6): Conveying paper sheet P.

Also, subsequent stage apparatus control section 30 instructs the execution of maintenance with respect to the corresponding parts subject to maintenance in cases in which subsequent stage apparatus control section 30 is instructed by preceding stage apparatus control section 20 to execute maintenance.

Post-processing control section 40 takes charge of all functions to control overall post-processing apparatus 400. Post-processing control section 40 is configured to eject paper sheet P, introduced from subsequent stage apparatus 300, straight onto elevating sheet ejection tray 430 (or fixed sheet ejection tray 440), or to stack paper sheet P on intermediate stacker 410 and eject it onto elevating sheet ejection tray 430 after a stapling process has been performed. A micro-computer, which is composed mainly of a CPU, ROM, RAM, and I/O interfaces, may be used as post-processing control section 40.

Figure 6:
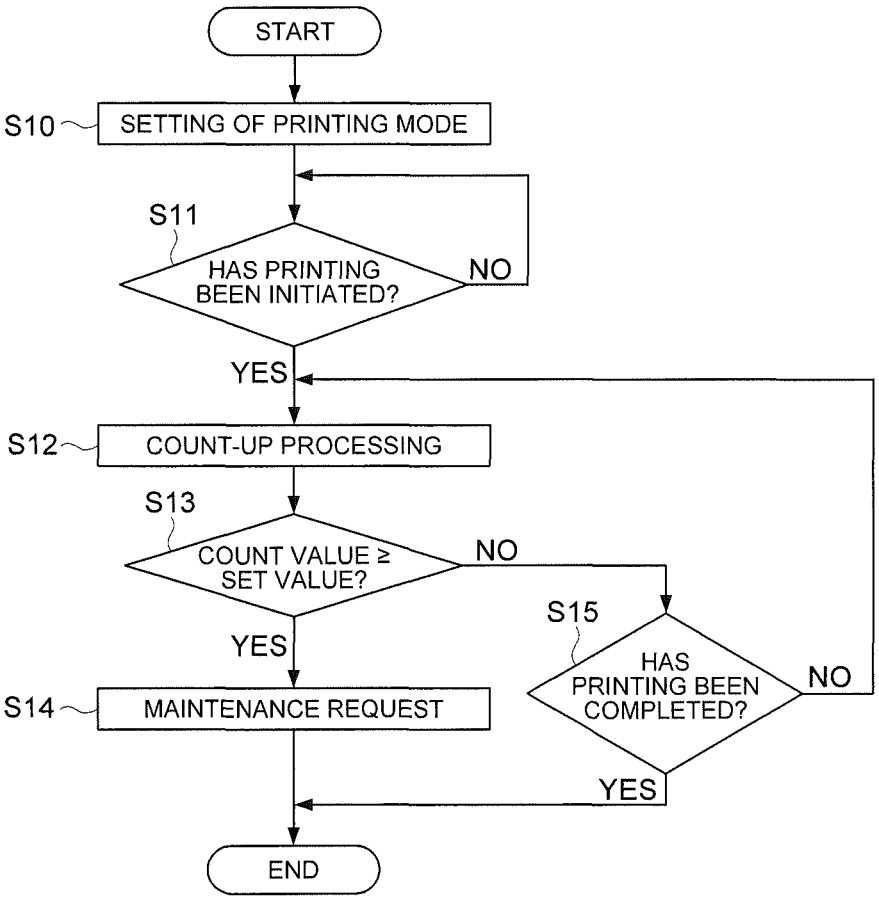
FIG. 6 is a flowchart illustrating a series of operations of the image forming system.

FIG. 6 is a flowchart illustrating a series of operations of the image forming system according to this preferred embodiment. The processing illustrated in this flowchart is executed via main control section 21 of preceding stage apparatus 200.

To begin with, in step 10 (S10), main control section 21 sets the operation mode of the image forming system by referring to user instruction information and image data, which are input via operation section 50. Also, main control section 21 outputs this information to each of control sections 10, 30 and 40, and instructs to set the operation mode of the image forming system. With such setting, each of control section 10 and 20 controls each of apparatuses 100-400 individually so that the image forming system operates in accordance with the operation modes of the image forming system. In the explanations below, "double-sided printing", "standard ratio of printing on both the front and back surfaces", "A4", and "pre-printed paper sheet" are set as the operation modes of the image forming system.

In step 11 (S11), main control section 21 determines whether or not printing has been initiated. The determination of initiation of printing can be made whether a user has operated the start button in operation section 50 or not, or whether initiation of printing has been instructed via a computer which is connected to the image forming system or not. If it was an affirmative determination in step 11, in other words, if it was determined that a printing has been initiated, the process flow advances to step 12 (S12). On the other hand, if it was a negative determination in step 11, in other words, if it was determined that a printing has not been initiated, the processing in step 11 is carried out again.

Figure 7:
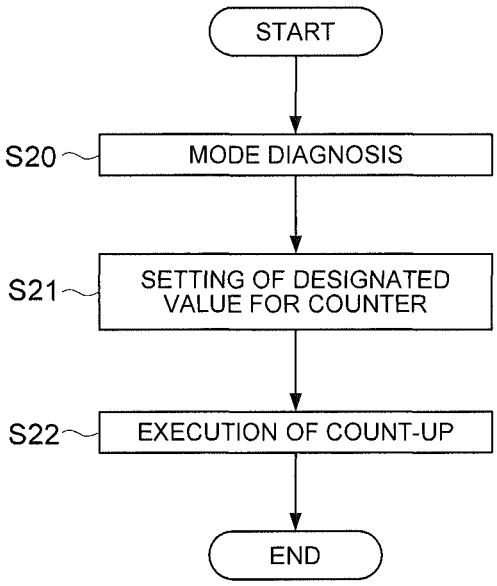
FIG. 7 is a flowchart illustrating details of a count-up processing.

In step 12, main control section 21 performs the count-up processing. FIG. 7 is a flowchart illustrating details of the count-up processing. To begin with, in step 20 (S20), main control section 21 diagnoses the operation mode of the image forming system (mode diagnosis). Via this mode diagnosis, image forming conditions, paper sheet conditions, and the like, are diagnosed.

In step 21 (S21), main control section 21 sets the designated values for preceding stage counters and the designated values for subsequent stage counters individually, based on the operation modes of the image forming system. The maintenance factors (the factors which have a correlation with maintenance cycle) are different with respect to preceding stage apparatus 200 and subsequent stage apparatus 300, and are different for each part which constitutes the image forming apparatuses. Meanwhile, those maintenance factors can be specified via the operation modes of the image forming system. Therefore, main control section 21 specifies the maintenance factors based on the operation modes of the image forming system, and sets the designated values for preceding stage counters and the designated values for subsequent stage counters individually, based on weighting corresponding to the specified maintenance factors with respect to preceding stage apparatus 200 and subsequent stage apparatus 300.

In the operation modes ("double-sided printing", "standard ratio of printing on both the front and back surfaces", "A4", and "pre-printed paper sheet") of the exemplified image forming apparatus according to this embodiment, the factors below are listed as typical maintenance factors. Specifically, they are:

Factor (1): Ink used in pre-printed paper sheet,

Factor (2): Dusting powder,

Factor (3): Paper dust.

(1) Ink Used in Pre-Printed Paper Sheet

For a pre-printed paper sheet, in general, an image is formed in advance via plate-making printing (offset printing) which uses ink, and "ink used in pre-printed paper sheet" represents the ink which is used to print the image to be formed in advance. In cases in which pre-printed paper sheets are used, it may be conceivable that the ink itself, or the gasified ink, which is generated when the ink vaporizes, is adhered onto parts which constitute the apparatuses. For example, when a large amount of the gasified ink is adhered to wire electrodes 233 and 333, there is a possibility that the charging performance with respect to the photosensitive drum may be lowered. Also, when a large amount of ink, or a large amount of gasified ink, is adhered to the conveyance system rollers, there is a possibility that failures of conveyance of paper sheet P may occur.

The gas of vaporized ink arises particularly in a high temperature environment such as the time when a paper sheet passes through fixing sections 240 and 340. Meanwhile, the higher the number of executions of fixing process with respect to a pre-printed paper sheet, the less amount of the gas of vaporized ink. Therefore, the adherence of gasified ink with respect to each of the maintenance parts tends to be reduced in subsequent stage apparatus 300 than in preceding stage apparatus 200.

Based on this standpoint, main control section 21 sets the designated values for counters with respect to preceding stage counter CF2 and subsequent stage counter CB2 which correlate with conveyance system rollers, and preceding stage counter CF5 and subsequent stage counter CB5 which correlate with wire electrodes 233 and 333, individually. Examples of the settings are described below.

(1-a) Maintenance Counter 22 which Correlates with the Conveyance System Rollers (Preceding Stage Counter CF2 and Subsequent Stage Counter CB2)

The designated value for preceding stage counter with respect to preceding stage counter CF2 is set to be larger value than the designated value for subsequent stage counter with respect to subsequent stage counter CB2. In this case, each individual designated value for the counter is set to be a larger value than the standard value (for example, the designated value for preceding stage counter=1.5, the designated value for subsequent stage counter=1.1).

(1-b) Maintenance Counter 22 which Correlates with Wire Electrodes 233 and 333 (Preceding Stage Counter CF5 and Subsequent Stage Counter CB5)

The designated values for preceding and subsequent stage counters are substantially the same as those of (1-a).

It should be noted that those designated values for counters are only examples. Obviously, because an influence of the gas of vaporized ink may differ in accordance with the area of ink in the pre-printed paper sheet and the type of ink, main control section 21 is configured to be able to set the designated values for counters by further considering those parameters. In this case, by setting the type of paper sheet P in more detail via operation section 50, such information can be reflected on the designated values for counters based on the operation mode of the image forming system.

(2) Dusting Powder

Dusting powder is a powder to be spread between paper sheets in order to inhibit sticking of paper sheets to each other, having been accumulated, due to the ink used for the pre-printed paper sheet, in cases in which pre-printed paper sheets are stacked and stored. Therefore, as the number of executions of image formation increases, dusting powder is scattered inside the apparatus. For example, exhaust fan filters become clogged by the dusting power, inside the apparatus, which is inhaled by exhaust fans 270 and 370, and there is a possibility that said clogging may lower the exhaust efficiency if the level of clogging becomes severe. Also, in case of the conveyance system rollers, the dusting powder may stick to the roller surfaces during the conveyance of pre-printed paper sheets, and conveyance failures tend to occur if dusting powder accumulates on the roller surfaces. Also, the brushes for rollers remove the accumulated dusting powder accumulated on conveyance rollers, but when the dusting powder accumulates on the brushes, the removal performance of dusting powder tends to be lower. Further, when the dusting powder is scattered during the conveyance of paper sheets and a large amount of the dusting powder is accumulated on paper sheet sensors 23 and 33, detection failures of paper sheet P tend to occur.

Here, because dusting powder is removed from the pre-printed paper sheet during the conveyance, the greater the conveyance length, the less effect of dusting powder. Therefore, an influence of dusting powder, with respect to each of the parts subject to maintenance, tends to be lower in subsequent stage apparatus 300 than in preceding stage apparatus 200.

Based on this standpoint, main control section 21 sets the designated values for counters with respect to preceding stage counter CF1 and subsequent stage counter CB1 which correlate with exhaust fan filters, preceding stage counter CF2 and subsequent stage counter CB2 which correlate with the conveyance system rollers, preceding stage counter CF3 and subsequent stage counter CB3 which correlate with the brushes for rollers, and preceding stage counter CF4 and subsequent stage counter CB4 which correlate with paper sheet sensors 23 and 33, individually. Examples of the settings are described below.

(2-a) Maintenance Counter 22 which Correlates with the Exhaust Fan Filters (Preceding Stage Counter CF1 and Subsequent Stage Counter CB1)

The designated value for preceding stage counter with respect to preceding stage counter CF1 is set to be a larger value than the designated value for subsequent stage counter with respect to subsequent stage counter CB1. In this case, the designated value for subsequent stage counter is set to the standard value, and the designated value for preceding stage counter is set to a larger value than the standard value (for example, the designated value for preceding stage counter=1.3, the designated value for subsequent stage counter=1.0).

(2-b) Maintenance Counter 22 which Correlates with the Conveyance System Rollers (Preceding Stage Counter CF2 and Subsequent Stage Counter CB2)

The designated values for preceding and subsequent stage counters are substantially the same as those of aforementioned (2-a).

(2-c) Maintenance Counter 22 which Correlates with the Brushes for Rollers (Preceding Stage Counter CF3 and Subsequent Stage Counter CB3)

The designated values for preceding and subsequent stage counters are substantially the same as those of aforementioned (2-a).

(2-d) Maintenance Counter 22 which Correlates with Paper Sheet Sensors 23 and 33 (Preceding Stage Counter CF4 and Subsequent Stage Counter CB4)

The designated values for preceding and subsequent stage counters are substantially the same as those of aforementioned (2-a).

It should be noted that those designated values for counters are examples. Obviously, because an influence of dusting powder may differ in accordance with the type of dusting powder, the amount per unit area and the sizes of paper sheets, main control section 21 is configured to be able to set the designated values for counters by further considering those parameters. In this case, by setting the type of paper sheet P in more detail via operation section 50, such information can be reflected in the designated values for counters based on the operation mode of the image forming system.

(3) Paper Dust

Paper dust represents paper fibers in the form of a powder (flour) removed from paper sheet. Therefore, as the number of the execution of image formation increases, paper dust is scattered within the apparatus. For example, exhaust fan filters, which are the parts subject to maintenance, are clogged by the paper dust, inside the apparatus, which is inhaled by exhaust fans 270 and 370, and there is a possibility that the clogging may lower the exhaust efficiency if the level of clogging becomes severe. Also, in case of the conveyance system rollers, which are the parts subject to maintenance, the paper dust may stick to the roller surfaces during the conveyance of pre-printed paper sheets, and conveyance failures tend to occur if the paper dust accumulates. Also, the brushes for rollers, which are the parts subject to maintenance, remove the accumulated dusting powder accumulated on conveyance rollers, but when the paper dust accumulates on the brushes, the removal performance of paper dust tends to be lower. Further, when the dusting powder is scattered during the conveyance of paper sheets and a large amount of dusting powder accumulates on paper sheet sensors 23 and 33, which are the parts subject to maintenance, detection failures of paper sheet P tend to occur.

Meanwhile, because paper dust is removed from the pre-printed paper sheet during the conveyance, the greater the conveyance length, the less influence of paper dust. Therefore, an influence of paper dust, with respect to each of the parts subject to maintenance, tends to be lower in subsequent stage apparatus 300 than in preceding stage apparatus 200.

Based on this standpoint, main control section 21 sets the designated values for counters with respect to preceding stage counter CF1 and subsequent stage counter CB1 which correlate with exhaust fan filters, preceding stage counter CF2 and subsequent stage counter CB2 which correlate with the conveyance system rollers, preceding stage counter CF3 and subsequent stage counter CB3 which are correlated with the brushes for rollers, and preceding stage counter CF4 and subsequent stage counter CB4 which correlate with paper sheet sensors 23 and 33, individually. Examples of the settings are described below.

(3-a) Maintenance Counter 22 which Correlates with the Exhaust Fan Filters (Preceding Stage Counter CF1 and Subsequent Stage Counter CB1)

The designated value for preceding stage counter with respect to preceding stage counter CF1 is set to be a larger value than the designated value for subsequent stage counter with respect to subsequent stage counter CB1. In this case, the designated value for subsequent stage counter is set to the standard value, and the designated value for preceding stage counter is set to be a larger value than the standard value (for example, the designated value for preceding stage counter=1.1, the designated value for subsequent stage counter=1.0). Here, because the particle diameter of dusting powder is smaller when compared with that of paper dust, dusting powder tends to accumulate easily on the parts subject to maintenance. Therefore, as the designated values for preceding stage counters to be set for paper dust, lower values than the values to be set for dusting powder are adopted.

(3-b) Maintenance Counter 22 which Correlates with the Conveyance System Rollers (Preceding Stage Counter CF2 and Subsequent Stage Counter CB2)

The designated values for preceding and subsequent stage counters are basically the same as those of aforementioned (3-a).

(3-c) Maintenance Counter 22 which Correlates with the Brushes for Rollers (Preceding Stage Counter CF3 and Subsequent Stage Counter CB3)

The designated values for preceding and subsequent stage counters are basically the same as those of aforementioned (3-a).

(3-d) Maintenance Counter 22 which Correlates with Paper Sheet Sensors 23 and 33 (Preceding Stage Counter CF4 and Subsequent Stage Counter CB4)

The designated values for preceding and subsequent stage counters are basically the same as those of aforementioned (3-a).

It should be noted that these designated values for counters are examples. Obviously, because the influence of paper dust may differ in accordance with the type and manufacture of paper sheet P, and the sizes of paper sheets, main control section 21 is configured to be able to set the designated values for counters by further considering those parameters. In this case, by setting the type of paper sheet P in more detail via operation section 50, such information can be reflected on the designated values for counters based on the operation mode of the image forming system.

By considering those factors, main control section 21 sets, for each of the parts subject to maintenance, the designated values for counters with respect to preceding stage counters CF1-CFN and subsequent stage counters CB1-CBN which are correlated with such parts, individually. In this case, when plural elements, such as ink used for pre-printed paper sheet, dusting powder, and paper dust, are associated, a representative value (as an example, a maximum value) of each of the designated values for counters may be set as a final designated value for the counters, or a simple average value or a weighted average value of each of the designated values for counters may be set as a final designated value for counters.

In step 22 (S22), main control section 21 executes a count-up with respect to each of preceding stage counters CF1-CFN and each of subsequent stage counters CB1-CBN, which constitute maintenance counter 22. In other words, main control section 21 increase the count values of preceding stage counters CF1-CFN by the designated values for preceding stage counters in response to the formation of toner images on paper sheet P, and at the same time, increases the count values of subsequent stage counters CB1-CBN by the designated values for subsequent stage counters.

By referring to FIG. 6 again, in step 13 (S13), main control section 21 determines, with respect to each of the parts subject to maintenance, whether or not the count values of preceding stage counters CF1-CFN and subsequent stage counters CB1-CBN are larger than or equal to set values. Said set values are the values to determine whether the parts subject to maintenance have reached the time of maintenance, and have been set in advance via experiment and simulation. If it was an affirmative determination in step 13, in other words, if it was determined that the count value was larger than or equal to the set value, the process flow advances to step 14 (S14). On the other hand, if it was a negative determination in step 13, in other words, if it was determined that the count value was less than the set value, the process flow advances to step 15 (S15).

In step 14 (S14), main control section 21 specifies the parts subject to maintenance which correlate with preceding stage counters CF1-CFN and subsequent stage counters CB1-CBN of which the count values have exceeded the set values, and main control section 21 makes a request for execution of maintenance. In cases in which maintenance can be executed automatically with respect to the parts subject to maintenance, such as cleaning of the wires of wire electrode, as an example, main control section 21 make a request for execution of maintenance. It should be noted that, in cases in which a part subject to maintenance, which has reached the time of maintenance, constitutes subsequent stage apparatus 300, main control section 21 makes a request of subsequent stage apparatus control section 30 for execution of maintenance. Meanwhile, in cases in which maintenance with respect to the parts subject to maintenance, such as the changing of exhaust fan filters, is to be executed manually, main control section 21 makes a notification that maintenance is necessary with respect to the parts, via display screen 51 of operation section 50, or the like.

In step 15, main control section 21 determines whether or not printing has been completed. More specifically, main control section 21 determines whether formation of toner images on paper sheet P has been completed, and also, whether said paper sheet P is the last paper sheet, or not. If it was an affirmative determination in step 15, in other words, if printing has been completed, main control section 21 terminate this process flow. On the other hand, if it was a negative determination in step 15, in other words, if printing has not been completed, the process flow advances to the process in step 12 again. Via this determination in step 15, in cases in which printing is carried out for a plurality of paper sheets P as a single job, count-up processing (step 12) is carried out for each paper sheet until the last paper sheet.

In such a way, in this preferred embodiment, main control section 21 is configured to increase the count values of preceding stage counters CF1-CFN (first maintenance counters) by the designated values for preceding stage counters (first designated values), and at the same time, increase the count values of subsequent stage counters CB1-CBN (second maintenance counters) by the designated values for subsequent stage counters (second designated values). In this case, main control section 21 sets the designated values for preceding stage counters and the designated values for subsequent stage counters individually based on the operation mode of the image forming system.

According to this structure, each of the designated values for preceding and subsequent stage counters can be set in accordance with the operation mode of the image forming system. Therefore, the time of maintenance with respect to the same parts subject to maintenance can be appropriately determined individually for preceding stage apparatus 200 and subsequent stage apparatus 300. In such a way, problems such as that image forming performance may deteriorate, and/or apparatus downtime associated with unnecessary maintenance may occur, can be solved.

Also, in this preferred embodiment, each of preceding stage counters CF1-CFN and subsequent stage counters CB1-CBN is provided for each individual part subject to maintenance which constitutes the image forming apparatuses.

According to this structure, since each of the designated values for preceding and subsequent stage counters, with respect to each of the parts subject to maintenance, can be set, each of the times of maintenance with respect to each of the parts can be appropriately determined individually for preceding stage apparatus 200 and subsequent stage apparatus 300.

Also, in this preferred embodiment, main control section 21 specifies the maintenance factors, which have a correlation with the maintenance cycle, based on the operation modes of the image forming system, and sets the designated values for preceding stage counters and the designated values for subsequent stage counters individually, based on weighting corresponding to the specified maintenance factors with respect to preceding stage apparatus 200 and subsequent stage apparatus 300.

According to this structure, by carrying out weighting corresponding to factors which determine the interval of the maintenance cycle, the designated values for preceding stage counters and the designated values for subsequent stage counters can be appropriately set individually. In such a way, the time of maintenance can be appropriately determined individually.

Also, in this preferred embodiment, the maintenance factors include at least one of"ink used for pre-printed sheet", "dusting powder", and "paper dust". In this case, main control section 21 sets larger designated values for preceding stage counters than the designated values of subsequent stage counters by making the maintenance cycle, for subsequent stage apparatus 300, smaller than the maintenance cycle for preceding stage apparatus 200, as an element of weighting.

According to this structure, in case of a printing mode in which pre-printed sheets of paper are used, the level of contamination inside the apparatuses will differ with respect to preceding stage apparatus 200 and subsequent stage apparatus 300. However, according to this preferred embodiment, the time of maintenance of each of the parts subject to maintenance of preceding stage apparatus 200 and subsequent stage apparatus 300 can be appropriately determined individually.

Second Preferred Embodiment

Hereinafter, an image forming system according to a second preferred embodiment of the present invention will be described. The difference of the image forming system, according to the second preferred embodiment, from the first preferred embodiment is found in the setting method of the designated values for preceding stage counters and the designated values for subsequent stage counters. More specifically, in the aforementioned preferred embodiment, "ink used for pre-printed paper sheet", "dusting powder" and "paper dust" are considered as maintenance factors, but in addition to these, a variety of other maintenance factors may be considered. In this preferred embodiment, the ratio of printing as a maintenance factor will be described.

In the description of this preferred embodiment, it is assumed that "double-sided printing", "low ratio of printing on both the front and back surfaces", "A4", and "normal paper sheet" are set as operation modes of the image forming system. It should be noted that, with respect to "low ratio of printing", by setting a ratio of printing with which scraping of a blade, which will be described later, may occur, as a standard ratio of printing in advance via experiment and simulation, a ratio of printing can be specified if it is a higher ratio of printing than or equal to the standard ratio of printing, or if it is a lower ratio of printing than the standard ratio, in comparison with said standard ratio of printing.

In this operation mode, (1) paper dust, and (2) ratio of printing, are considered as maintenance factors. Here, with regard to (1) paper dust, because it is the same in the first preferred embodiment, explanations in this preferred embodiment are omitted.

(2) Ratio of Printing

In cases in which a blade is used as drum cleaning sections 234 and 334, the blade removes the residual toner by scraping the surface of photosensitive drums 231 and 331. According to this structure, in cases in which the ratio of printing is low, the tip portion of the blade tends to be abraded readily because the amount of toner, which plays the role of a lubricant agent, is low. As the abrasion amount of the blade becomes larger, the cleaning performance at the surface of photosensitive drums 231 and 331 is lowered, and thereby, degrading image forming performance.

Based on this standpoint, main control section 21 sets individually the designated values for counters with respect to preceding stage counter CFN and subsequent stage counter CBN which correlate with drum cleaning sections 234 and 334. More specifically, main control section 21 sets the designated values for preceding and subsequent stage counters at the same value, and also, sets each of the designated values to a larger value than the standard value (for example, designated value for preceding stage counter=1.1, designated value for subsequent stage counter=1.1).

It should be noted that, because the exemplified ratio of printing is assumed to be low for both the front and back surfaces, the designated values for preceding and subsequent stage counters are set at the same value. However, in cases in which the ratio of printing on the front surface of paper sheet P is the standard ratio of printing and the ratio of printing on the back surface is a low ratio of printing, the designated value for preceding stage counter may be set to the standard value, and the designated value for subsequent stage counter may only be set to a larger value than the standard value (for example, designated value for preceding stage counter=1.0, designated value for subsequent stage counter=1.1). On the other hand, in cases in which the ratio of printing on the front surface is a low ratio of printing and the ratio of printing on the back surface is the standard ratio of printing, only the designated value for preceding stage counter may be set to a larger value than the standard value, and the designated value for subsequent stage counter may be set to the standard value (for example, designated value for preceding stage counter=1.1, designated value for subsequent stage counter=1.0).

In this way, according to this preferred embodiment, the time of maintenance with respect to the same parts subject to maintenance can be appropriately determined individually for preceding stage apparatus 200 and subsequent stage apparatus 300. In such a way, problems by which image forming performance may deteriorate, and/or apparatus downtime associated with unnecessary maintenance may occur, can be solved.

Third Preferred Embodiment

Hereinafter, an image forming system according a third preferred embodiment of the present invention will be described. The difference of the image forming system according to the third preferred embodiment from the first and second preferred embodiments is found in the setting method of the designated values for preceding stage counters and the designated values for subsequent stage counters. More specifically, although explanations were made on the assumption of double-sided printing in the aforementioned preferred embodiments, explanations will be made with respect to single-sided printing.

In cases of a structure of a serial tandem type image forming system in which image forming apparatuses are connected in series, when printing is formed on only the front surface of paper sheet P, the image formation is carried out only via preceding stage apparatus 200, and, on the other hand, when printing is formed only of the back surface, the image formation is carried out only via subsequent stage apparatus 300. Hereinafter, setting method of the designated value for preceding stage counter and the designated value for subsequent stage counter, with respect to each case, will be described.

To begin with, the cases, in which printing is carried out on only the front surface of paper sheet P, will be described. With regard to the designated values for preceding stage counters, the designated values can be set in a similar manner to the designated values for preceding stage counters with respect to preceding stage apparatus 200, described in the first or second preferred embodiment. That is, even in cases in which printing is carried out on only the front surface, the operation of preceding stage apparatus 200 is substantially the same as the cases in which printing is carried out on both the front and back surfaces.

On the other hand, with regard to the designated values for subsequent stage counters, the designated values are set based on a different criteria compared to the designated values for subsequent stage counters with respect to subsequent stage apparatus 300, described in the first or second preferred embodiment. That is because image formation via subsequent stage apparatus 300 is not carried out, and therefore, maintenance factors cannot be considered to be the same.

(1) Ink Used for Pre-Printed Paper Sheet, Dusting Powder, Paper Dust

With regard to the designated value for subsequent stage counter which correlates with each of the parts subject to maintenance which has those factors as maintenance factors, the designated value for the subsequent stage counters can be set in a similar manner to the designated values for the preceding stage counters with respect to subsequent stage apparatus 300, described in the first or second preferred embodiment. That is because the influence of those maintenance factors on preceding stage apparatus 200 is dominant regardless of the presence or absence of image formation via subsequent stage apparatus 300.

(2) Ratio of Printing

In cases in which image formation via subsequent stage apparatus 300 is not carried out, the necessity to consider the ratio of printing is low. Therefore, the designated value for subsequent stage counter which correlates with drum cleaning section 334 is set to "0.0", as an example.

Next, the case, in which printing is performed only on the back surface of paper sheet P, will be described. In this case, with respect to paper sheet P on which toner images are formed on the back surface thereof via subsequent stage apparatus 300, there is a method in which paper sheet P is fed from sheet feeding section 350 of subsequent stage apparatus 300 without passing through preceding stage apparatus 200, and is another method in which paper sheet P is fed from sheet feeding section 110 of large-capacity sheet feeder 100 and is conveyed through the inside of preceding stage apparatus 200.

In the former feeding method, preceding stage apparatus 200 does not contribute the operation even if image formation onto paper sheet P is carried out. Therefore, each of the designated values for preceding stage counters may be set to "0.0", as an example.

On the other hand, the designated values for subsequent stage counters can be set to larger values compared to the designated values for subsequent stage counters of the case in double-sided printing described in the first preferred embodiment. For example, the values, described in the first preferred embodiment as an example of the designated values for preceding stage counters, may be used as a substitute. This is because influence of ink used for pre-printed paper sheet, dusting powder, and paper dust is directly manifested in subsequent stage apparatus 300, in cases in which paper sheet P is not passed through preceding stage apparatus 200.

On the other hand, in the latter feeding method, the designated values for preceding stage counters may be set from the following point of view. For example, for the parts subject to maintenance to which paper dust and dusting powder become maintenance factors, the designated values for the preceding stage counters can be set based on the same point of view as the scene of double-sided printing described in the first preferred embodiment. Further, with respect to the parts subject to maintenance to which the ratio of printing becomes a maintenance factor, "0.0" can be set, as an example.

On the other hand, the designated value for subsequent stage counters may be set based on the following point of view. For example, with respect to the parts subject to maintenance to which paper dust and dusting powder become maintenance factors, the designated values for subsequent stage counters can be set based on the same point of view as the scene of double-sided printing described in the first preferred embodiment. Also, with respect to the parts subject to maintenance in which ink used in pre-printed paper sheet becomes a maintenance factor, larger values, compared to the case of double-sided printing, can be set. This is because influence of the gas of vaporized ink appears conspicuously when paper sheet P passes through fixing section 340 of subsequent stage apparatus 300 for the first time. Further, with respect to the parts subject to maintenance to which the ratio of printing becomes a maintenance factor, the designated values for the subsequent stage counters can be set based on the same point of view as in the case of double-sided printing.

In this way, according to this preferred embodiment, the time of maintenance with respect to the same parts subject to maintenance can be appropriately determined individually for preceding stage apparatus 200 and subsequent stage apparatus 300. In such a way, problems in which image forming performance may deteriorate, and/or apparatus downtime associated with unnecessary maintenance may occur, can be solved.

Fourth Preferred Embodiment

Figure 8:
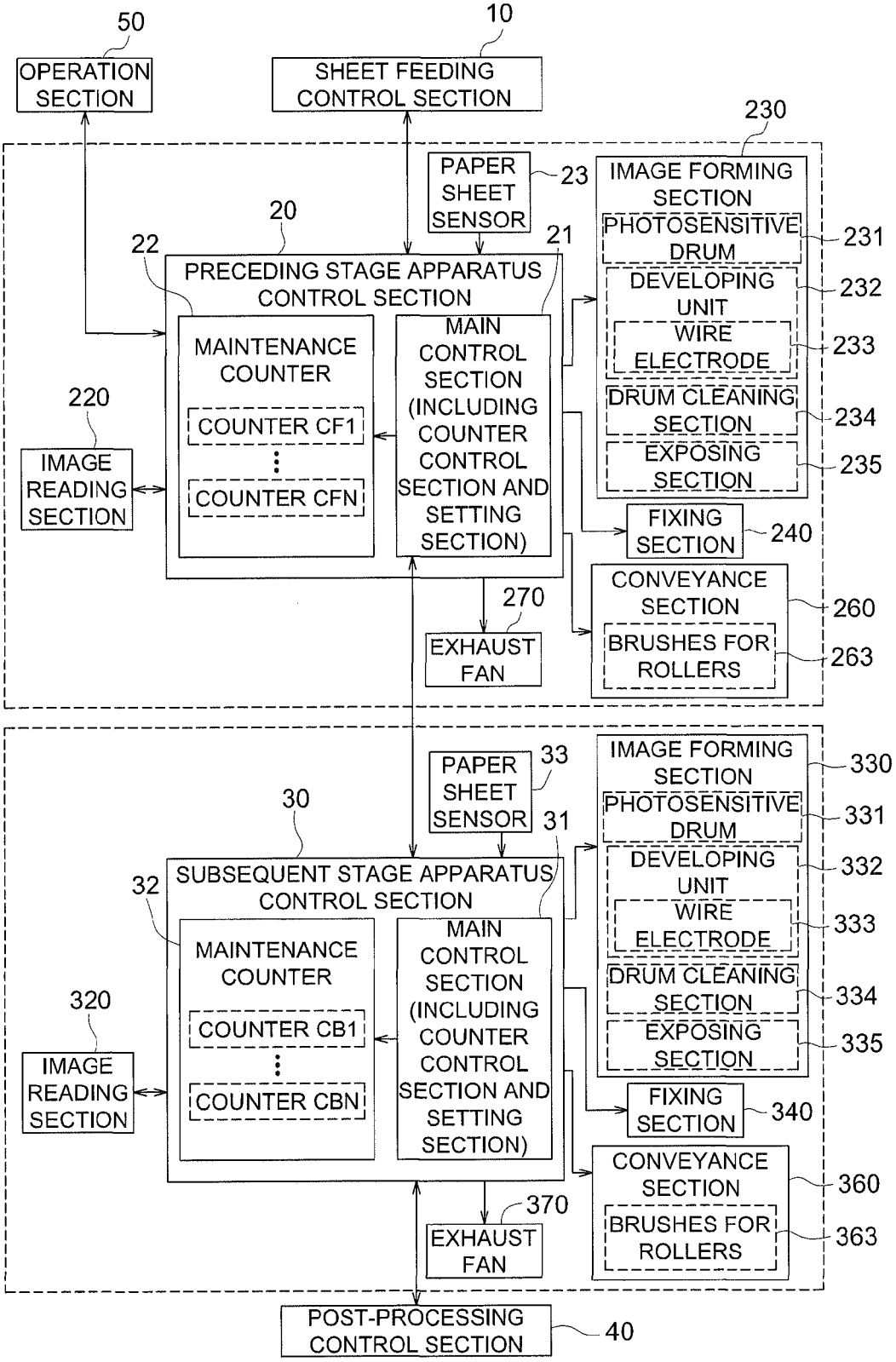
FIG. 8 is a diagram schematically illustrating a constitution of an image forming system according to a fourth embodiment.

FIG. 8 is a diagram schematically illustrating a constitution of an image forming system according to a fourth embodiment of the present invention. The difference of the image forming system, according to this preferred embodiment from the aforementioned preferred embodiments, is found in the constitution of the maintenance counter.

More specifically, preceding stage apparatus control section 20 includes main control section 21 and maintenance counter 22. In the aforementioned embodiments, maintenance counter 22 includes counters CF1-CFN and CB1-CBN which correlate with preceding stage apparatus 200 and subsequent stage apparatus 300, respectively. Meanwhile, maintenance counter 22, according to this preferred embodiment, includes only counters CF1-CFN which correlate with the parts subject to maintenance included in preceding stage apparatus 200.

On the other hand, subsequent stage apparatus control section 30 includes main control section 31 and maintenance counter 32. Main control section 31 takes charge of all functions to control subsequent stage apparatus 300 wholly. Maintenance counter 32 includes only counters CB1-CBN which correlate with the parts subject to maintenance included in subsequent stage apparatus 300.

In such a structure, the count-up processing and setting of each designated value for the counters are executed via each of main control sections 21 and 31 in cooperation in a same manner in which those are executed via main control section 21, described in the aforementioned preferred embodiments.

According to this structure, because the image forming apparatuses are not necessarily dedicated to preceding stage apparatus 200 or subsequent stage apparatus 300, greater versatility can be obtained.

Although the preferred embodiments of the present invention have been fully described by way of examples with reference to the accompanying drawings, it is to be noted that various changes and modifications will be apparent to those skilled in the art. Therefore, unless such changes and modifications depart from the scope of the present invention, they are to be construed as being included therein. For example, the present invention can be applied not only to a serial tandem type image forming system, in which two image forming apparatuses are connected in series, but also to a serial tandem type image forming system, in which three or more image forming apparatuses are connected in series. In this case, by considering an image forming apparatus which is disposed in a location in a conveyance direction of paper sheet, and other image forming apparatuses which are disposed downstream thereof, as a preceding stage apparatus and subsequent stage apparatuses, respectively, the aforementioned idea can be applied.

What is claimed is:

1. An image forming system having a preceding stage apparatus, which is an image forming apparatus for forming a toner image on a paper sheet, and a subsequent stage apparatus, which is an image forming apparatus and is connected downstream of said preceding stage apparatus, for forming a toner image on the paper sheet having been ejected from said preceding stage apparatus, the image forming system comprising:

a first maintenance counter which correlates with a part, subject to maintenance, in said preceding stage apparatus;

a second maintenance counter which correlates with a part, subject to maintenance, in said subsequent stage apparatus, in correspondence with said first maintenance counter;

a counter control section configured to increase a count value of said first maintenance counter by a first designated value, in response to formation of a toner image on a paper sheet, and increase a count value of said second maintenance counter by a second designated value; and a setting section configured to set said first designated value and said second designated value individually based on an operation mode of the image forming system;

wherein a time of maintenance is determined with respect to said part, subject to maintenance, by comparing the count value of said first maintenance counter and the count value of said second maintenance counter, with a predetermined set value.

2. The image forming system described in claim 1, wherein each of said first maintenance counter and said second maintenance counter is provided to each individual part subject to maintenance, the individual part which constitutes said image forming apparatuses.

3. The image forming system described in claim 1, wherein said setting section is configured to (a) identify a maintenance factor, which is a factor correlating with a maintenance cycle, based on an operation mode of the image forming system, and (b) set said first designated value and said second designated value individually in accordance with the identified maintenance factor.

4. The image forming system described in claim 3, wherein said maintenance factor comprises an ink used for printing of an image, having been formed in advance on a paper sheet, the paper sheet that is subject to formation of a toner image, and said part, subject to maintenance, comprises at least one of a member used for feeding or conveying a paper sheet, and a wire electrode for charging a photosensitive member.

5. The image forming system described in claim 3, wherein said maintenance factor comprises a dusting powder for inhibiting an adherence between accumulated paper sheets due to the ink, and said part, subject to maintenance, comprises at least one of a member used for feeding or conveying a paper sheet, a cleaning member for said member, a filter for exhausting an atmosphere inside the apparatus, and a detector disposed in a conveyance path of the paper sheet.

6. The image forming system described in claim 3, wherein said maintenance factor comprises paper dust composed of paper fibers which are removed in a powder state, and said part, subject to maintenance, comprises at least one of a member used for feeding or conveying a paper sheet, a cleaning member for said member, a filter for exhausting an atmosphere inside the apparatus, and a detector disposed in a conveyance path of the paper sheet.

7. The image forming system described in claim 4, wherein said setting section is configured to set said first designated value to be a larger value than said second designated value so as to make a maintenance period of said preceding stage apparatus shorter than a maintenance cycle of said subsequent stage apparatus.

8. The image forming system described in claim 7, wherein said setting section is configured to set said first designated value to be in a relationship in which the individual first designated values become relatively smaller in the order of the ink, dusting powder, and paper dust which are said maintenance factors.

9. The image forming system described in claim 3, wherein said maintenance factor comprises a ratio of printing of toner image to be formed on one surface of a paper sheet, and said part, subject to maintenance, comprises a blade to remove residual toner by scraping a surface of the photosensitive body.

10. The image forming system described in claim 9, wherein said setting section is configured to (a) set said first designated value to a larger value compared with a case of a standard ratio of printing, in a case in which said setting section has determined that the printing ratio on a surface of the paper sheet, onto which a toner image is formed, is low, in said preceding stage apparatus, and (b) set said second designated value to a larger value compared with a case of a standard ratio of printing, in a case in which said setting section has determined that the printing ratio on a surface of the paper sheet, onto which a toner image is formed, in said subsequent stage apparatus, is low.

11. A maintenance method of an image forming system having a preceding stage apparatus, which is an image forming apparatus for forming a toner image on a paper sheet, and a subsequent stage apparatus, which is an image forming apparatus and is connected downstream of said preceding stage apparatus, for forming a toner image on the paper sheet having been ejected from said preceding stage apparatus, the maintenance method comprising steps of:

setting with a setting section a first designated value that is used for a first maintenance counter in accordance with an operation mode of the image forming system, the first maintenance counter which correlates with a part, subject to maintenance, in said preceding stage apparatus;

setting a second designated value that is used for a second maintenance counter in accordance with an operation mode of the image forming system, the second maintenance counter which correlates with a part, subject to maintenance, in said subsequent stage apparatus, in correspondence with said first maintenance counter;

increasing a count value of said first maintenance counter by said first designated value, and increasing a count value of said second maintenance counter by said second designated value; and determining a time of maintenance with respect to said part, subject to maintenance, by comparing a count value of said first maintenance counter and a count value of said second maintenance counter, with a predetermined set value.

12. The method described in claim 11, wherein each of said first maintenance counter and said second maintenance counter is provided to each individual part subject to maintenance, the individual part which constitutes said image forming apparatuses.

13. The method described in claim 11, wherein said setting section is configured to (a) identify a maintenance factor, which is a factor correlating with a maintenance cycle, based on an operation mode of the image forming system, and (b) set said first designated value and said second designated value individually in accordance with the identified maintenance factor.

14. The method described in claim 13, wherein said maintenance factor comprises an ink used for printing of an image, having been formed in advance on a paper sheet, the paper sheet that is subject to formation of a toner image, and said part, subject to maintenance, comprises at least one of a member used for feeding or conveying a paper sheet, and a wire electrode for charging a photosensitive member.

15. The method described in claim 13, wherein said maintenance factor comprises a dusting powder for inhibiting an adherence between accumulated paper sheets due to the ink, and said part, subject to maintenance, comprises at least one of a member used for feeding or conveying a paper sheet, a cleaning member for said member, a filter for exhausting an atmosphere inside the apparatus, and a detector disposed in a conveyance path of the paper sheet.

16. The method described in claim 13, wherein said maintenance factor comprises paper dust composed of paper fibers which are removed in a powder state, and said part, subject to maintenance, comprises at least one of a member used for feeding or conveying a paper sheet, a cleaning member for said member, a filter for exhausting an atmosphere inside the apparatus, and a detector disposed in a conveyance path of the paper sheet.

17. The method described in claim 14, wherein said setting section is configured to set said first designated value to be a larger value than said second designated value so as to make a maintenance period of said preceding stage apparatus shorter than a maintenance cycle of said subsequent stage apparatus.

18. The method described in claim 17, wherein said setting section is configured to set said first designated value to be in a relationship in which the individual first designated values become relatively smaller in the order of the ink, dusting powder, and paper dust which are said maintenance factors.

19. The method described in claim 13, wherein said maintenance factor comprises a ratio of printing of toner image to be formed on one surface of a paper sheet, and said part, subject to maintenance, comprises a blade to remove residual toner by scraping a surface of the photosensitive body.

20. The method described in claim 19, wherein said setting section is configured to (a) set said first designated value to a larger value compared with a case of a standard ratio of printing, in a case in which said setting section has determined that the printing ratio on a surface of the paper sheet, onto which a toner image is formed, is low, in said preceding stage apparatus, and (b) set said second designated value to a larger value compared with a case of a standard ratio of printing, in a case in which said setting section has determined that the printing ratio on a surface of the paper sheet, onto which a toner image is formed, in said subsequent stage apparatus, is low.

* * * * *